US009799309B2

(12) United States Patent
Cirillo

(10) Patent No.: US 9,799,309 B2
(45) Date of Patent: Oct. 24, 2017

(54) DYNAMIC FRET

(71) Applicant: Antonio Cirillo, Rutigliano (IT)

(72) Inventor: Antonio Cirillo, Rutigliano (IT)

( * ) Notice: Subject to any disclaimer, the term of this patent is extended or adjusted under 35 U.S.C. 154(b) by 0 days.

(21) Appl. No.: 15/509,245

(22) PCT Filed: Sep. 7, 2015

(86) PCT No.: PCT/IT2015/000213

§ 371 (c)(1),
(2) Date: Mar. 7, 2017

(87) PCT Pub. No.: WO2016/038638

PCT Pub. Date: Mar. 17, 2016

(65) Prior Publication Data

US 2017/0256241 A1 Sep. 7, 2017

(30) Foreign Application Priority Data

Sep. 9, 2014 (IT) ..... BA2014A0058

(51) Int. Cl.
*G10D 3/08* (2006.01)

(52) U.S. Cl.
CPC ..... *G10D 3/08* (2013.01)

(58) Field of Classification Search
CPC ..... G10D 3/06
See application file for complete search history.

(56) References Cited

U.S. PATENT DOCUMENTS 1,727,230 A 9/1929 Cox
3,273,439 A * 9/1966 Keefe ..... G10D 3/06 84/314 R
2011/0239841 A1 10/2011 Stockwell

FOREIGN PATENT DOCUMENTS

DE 3705625 A1 10/1987
DE 202007018484 U1 10/2008
EP 0283592 A1 9/1988

* cited by examiner

*Primary Examiner* — Kimberly Lockett
(74) *Attorney, Agent, or Firm* — Ward Law Office LLC; Jacob M. Ward

(57) ABSTRACT

A mechanical device is described, integrated in a fret board of a cord-type music instrument as replacement of a fret adapted to cross the fret board from the front surface to the rear surface of the fret board; the mechanical device comprises: a bridge element arranged on the rear surface of the fret board; a rider means, adapted to vertically cross the fret board of the cord-type music instrument and to be connected with the bridge element; an elastic means, equipped with a first end connected to the bridge element, and with a second end strictly connected to at least one room obtained in the fret board.

15 Claims, 8 Drawing Sheets

DYNAMIC FRET

CROSS-REFERENCE TO RELATED APPLICATIONS

This patent application is a United States National Phase Patent Application based on PCT/IT2015/000213, filed Sep. 7, 2015, which in turn claims the benefit of Italian Patent Application No. BA2014A000058, filed Sep. 9, 2014. The entire disclosures of the above patent applications are hereby incorporated herein by reference.

BACKGROUND OF THE INVENTION

1) Field of the Invention

The present invention refers to a dynamic fret, in particular to a mechanical device integrated in the fret board of a cord-type music instrument.

2) Background Art

According to Applicant's knowledge, there are no prior art mechanical devices which obtain the objects of the present invention.

SUMMARY OF THE INVENTION

Object of the present invention is providing a mechanical device adapted to simplify and optimize the use of a cord-type music instrument.

A further object is providing a mechanical device capable of allowing the use of a cord-type music instrument for disabled people.

The above and other objects and advantages of the invention, as will appear from the following description, are obtained with a mechanical device. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) could be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 4:
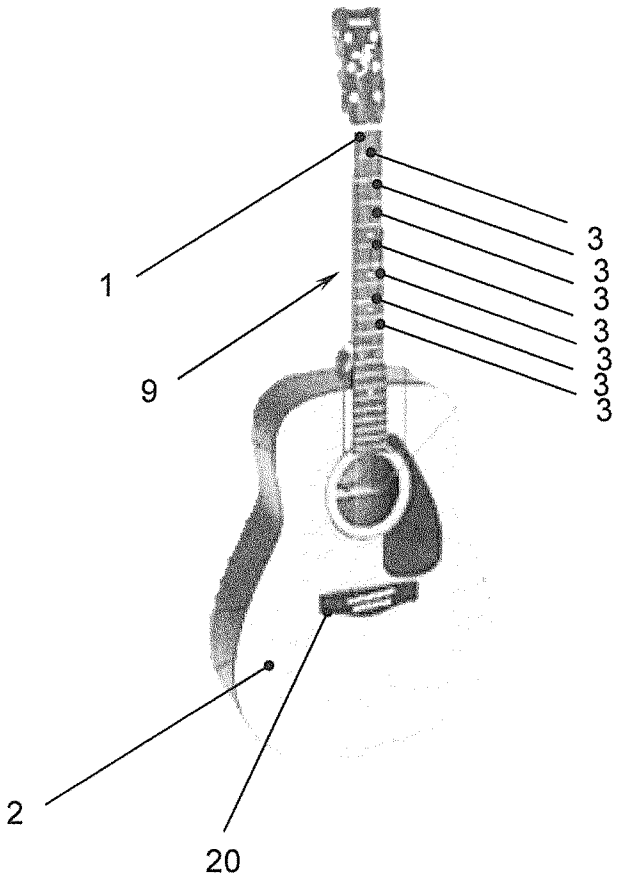
FIG. 4 shows a traditional cord-type music instrument and its related components.

A traditional music instrument, as shown in FIG. 4, is composed of a fret board 9, on which a keyboard is placed, which extends from the main fret 1, till the harmonic box 2; the keyboard is composed of at least one fret 3 such as, for example, a projecting fixed line made of metal, inserted parallel to the main fret 1. A user performs a pressure on the chords arranged along the keyboard next to the fret 3.

With reference to the FIGS. 1-8, the mechanical device 10 according to the present invention is integrated in the fret board 9, operating as keyboard, of a cord-type music instrument as replacement of at least one fret 3 of the fret board 9 of a traditional music instrument.

In particular, the mechanical device 10, according to the present invention is adapted to cross the fret board 9 of the cord-type music instrument, from the front surface to the rear surface of the fret board 9, and further comprises:

at least one bridge element 6, such as, for example, a fastening plate or other similar element, arranged on the rear surface of the fret board 9;

at least one rider means 4; and at least one elastic means 8, equipped with a first end connected to the bridge element 6, and with a second end strictly connected to a room, preferably a cylindrical section, obtained inside the fret board 9.

The rider means 4 is composed of at least one horizontal element 4*a*, placed on the front surface of the fret board 9 of the cord-type music instrument and of at least two vertical elements 4*b* connected on the top to the horizontal element 4*a*, conferring to the rider means 4 a $\pi$ shape.

Figure 1:
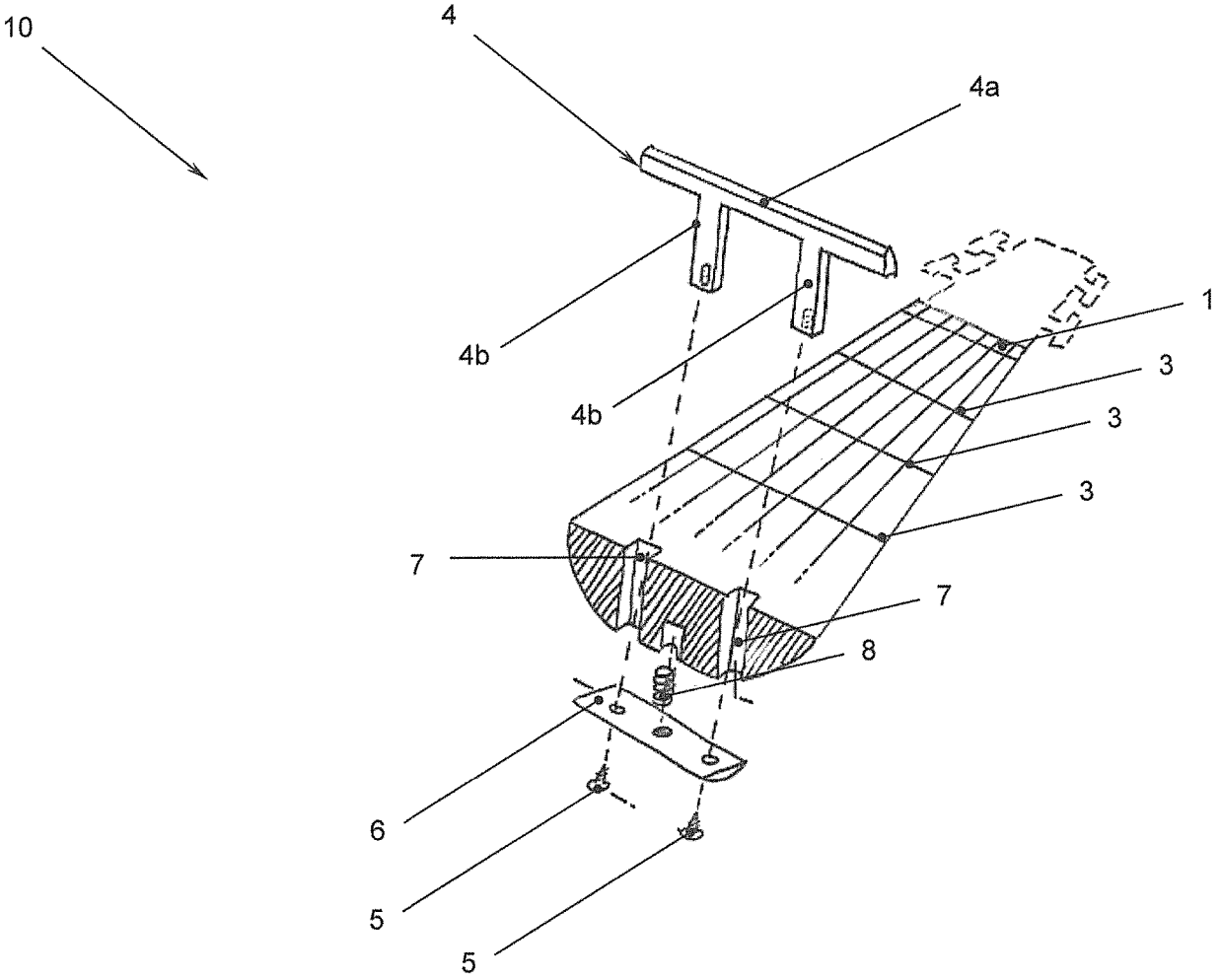
FIG. 1 shows a sectional view of the components of the mechanical device according to the present invention.
Figure 2:
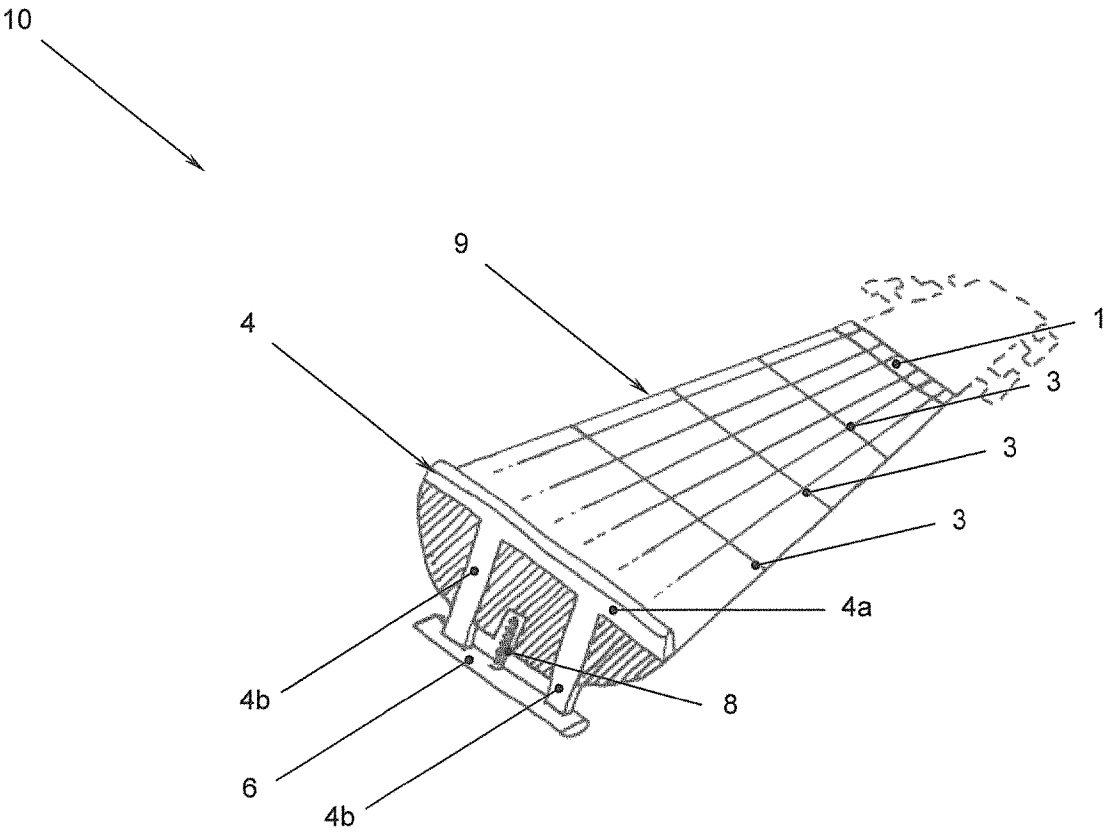
FIG. 2 shows a sectional view of the mechanical device in a static configuration according to the present invention.
Figure 3:
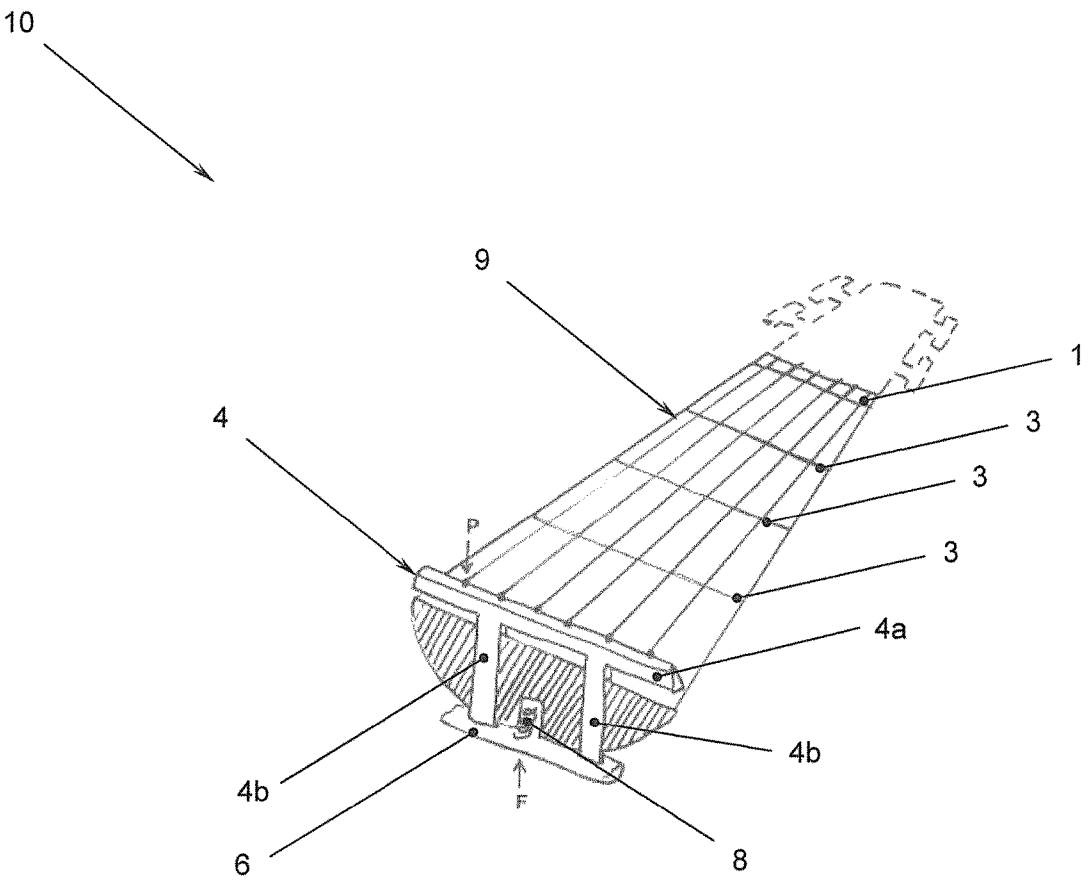
FIG. 3 shows a sectional view of the mechanical device in a dynamic configuration according to the present invention.

As shown in FIGS. 1, 2, and 3, the two vertical elements 4*b* are adapted to vertically cross the fret board 9, through at least two vertical holes 7, and to be connected on the bottom, through a plurality of fastening means 5, to the bridge element 6, arranged on the rear surface of the fret board 9 of the music instrument.

The mechanical device 10 integrated in the fret board 9 of the cord-type music instrument is adapted, through the action of the thumb of the user's hand, to perform a homogeneous pressure on a plurality of chords horizontally stretched on the fret board 9 of the music instrument.

In particular, the mechanical device 10 is activated by the pressing action of the thumb of the user's hand, ergonomically placed on the rear surface of the fret board 9 of the music instrument, impressing a force F on the bridge element 6, the force F is transmitted by the elastic element 8, which by contracting itself induces a vertical upward movement of the mechanical device 10, allowing the contact in at least one point P of the rider means 4 with the plurality of chords of the music instrument, configuring the mechanical device 10 in a dynamic phase, as shown in FIG. 3.

Finally, the pressing action of the thumb of the user's hand, is followed by a release action of the bridge element 6, inducing the release of the elastic element 8, and the vertical downwards movement of the mechanical device 10, configuring the mechanical device 10 in a static phase, as shown in FIG. 2.

As known, stationary waves are a particular interferential phenomenon, obtained through two harmonic waves which have the same amplitude and the same frequency and propagate themselves along opposite directions. Stationary waves propagate along the plurality of chords of the music instrument; moreover, every point of the stationary wave oscillates with an amplitude value, according to longitudinal and transverse vibrations without any energy transport: in particular, the central portion of the plurality of chords is characterized by an oscillation amplitude value greater than the one characterizing the extreme portions of the plurality of chords.

Figure 5:
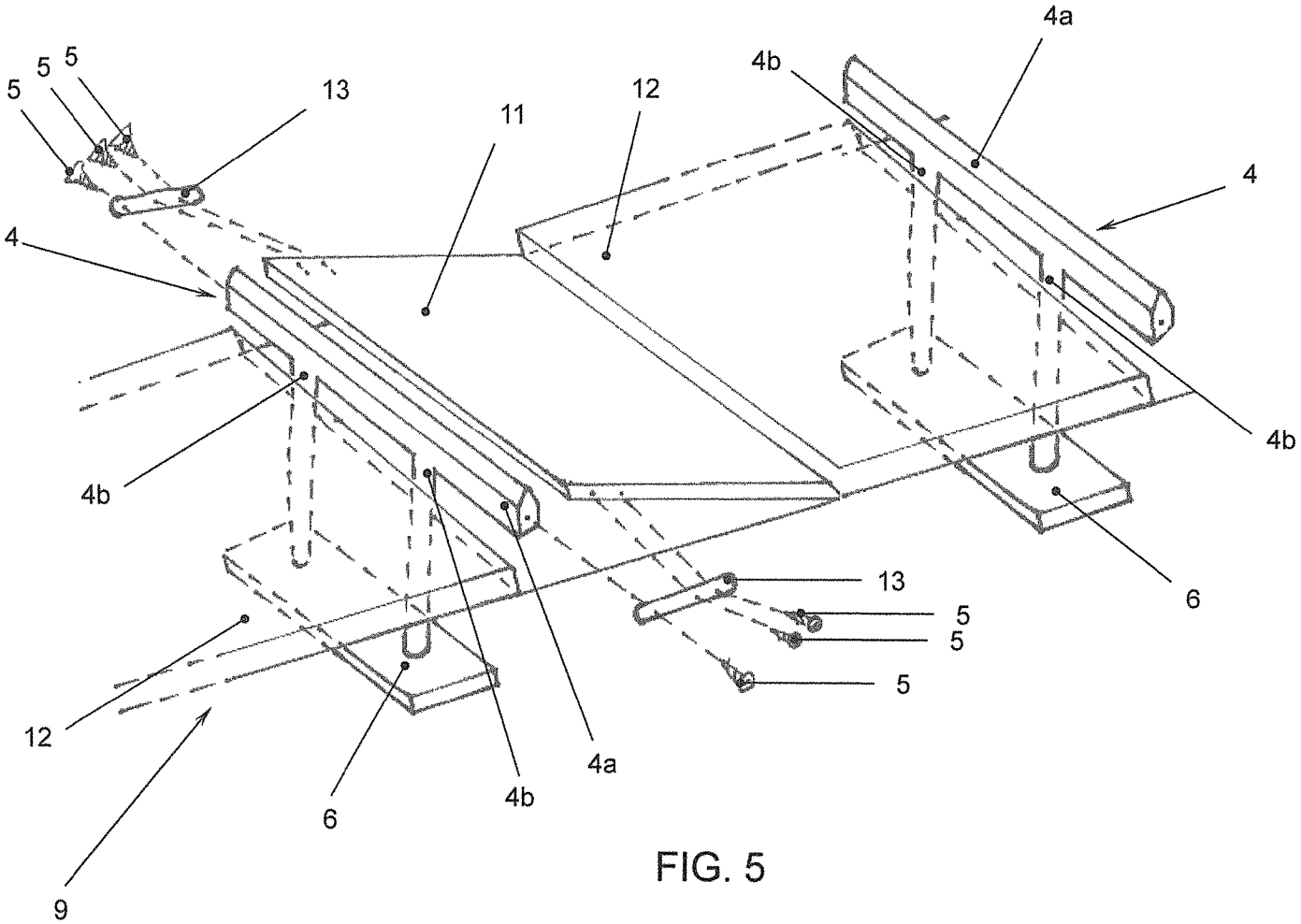
FIG. 5 shows a sectional view of the mechanical device in an optimized configuration according to the present invention.

Advantageously, as shown in FIG. 5, the fret board 9 of the cord-type music instrument is equipped, in its central portion, with at least one removable keyboard portion 11, fastened to the horizontal element 4*a* of the rider means 4, through at least one mechanical fastening system, adapted to enable a rotary movement of the removable keyboard portion 11 by an angle α, equal for example to 30°.

In particular, the central portion of the keyboard placed on the fret board 9 of the cord-type music instrument, comprises at least one mechanical device 10, at least one removable keyboard portion 11 and at least one fixed keyboard portion 12.

In particular a first and a second lateral profile of the portion of the removable keyboard 11 are arranged parallel to the horizontal element 4*a*, and respectively fastened to the horizontal element 4*a* through the mechanical fastening system, and to a first lateral profile of the fixed keyboard portion 12, through a chemical fastening system, such as for example glue, or other similar system, adapted to enable the rotary movement of the removable keyboard portion 11. Finally, the first and a second lateral profile of the portion of the keyboard portion 12 are arranged in parallel to the horizontal element 4*a* and to the removable keyboard portion 11; in particular the second lateral profile of the fixed keyboard portion 12 is next to the horizontal element 4*a*, of the rider means 4.

The mechanical fastening system comprises at least one connecting element 13, such as, for example, a plate or a slit, or other similar element, and a plurality of fastening means 5 such as screws, slots, etc., and is adapted to the connection of the horizontal element 4*a* with the first lateral profile of the removable keyboard portion 11, through the connection of each end of the horizontal element 4*a* respectively with a third and a fourth profile of the removable keyboard portion 11.

As previously described, the pressing action of the thumb of the user's hand on the mechanical device 10, allows the contact, in the point P, of the rider means 4, with the plurality of chords of the music instrument, configuring the mechanical device 10 in a dynamic phase and inducing, through the contraction of the elastic element 8, a vertical movement of the mechanical device 10. In order to optimize the contact in at least one point P of the rider means 4 with the plurality of chords in the central portion of the fret board 9, the same pressing action induces, through the contraction of the elastic element 8, a vertical upwards movement of the horizontal element 4*a* and a rotary movement by an angle α of the removable keyboard portion 11, connected to the horizontal element 4*a*.

Figure 6:
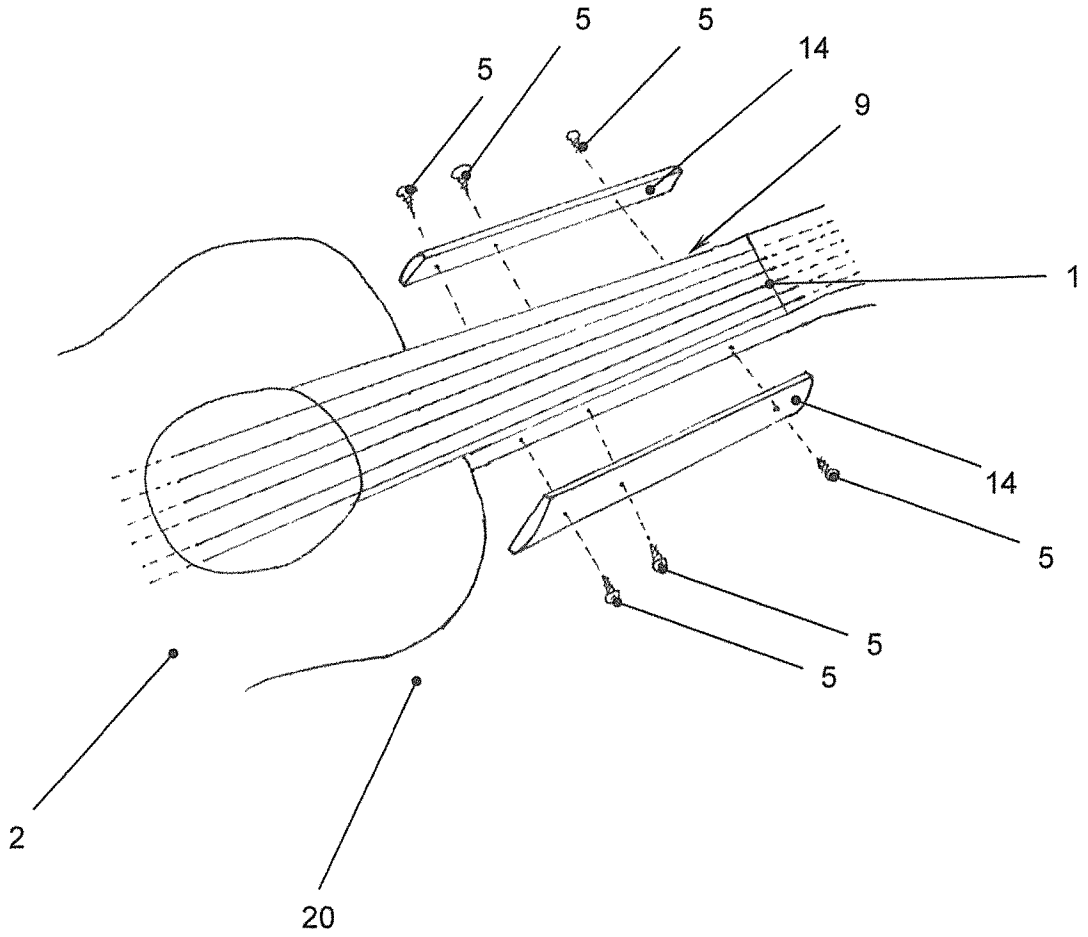
FIGS. 6, 7, 8 show a three-dimensional view of optimizing elements for the mechanical device according to the present invention
Figure 7:
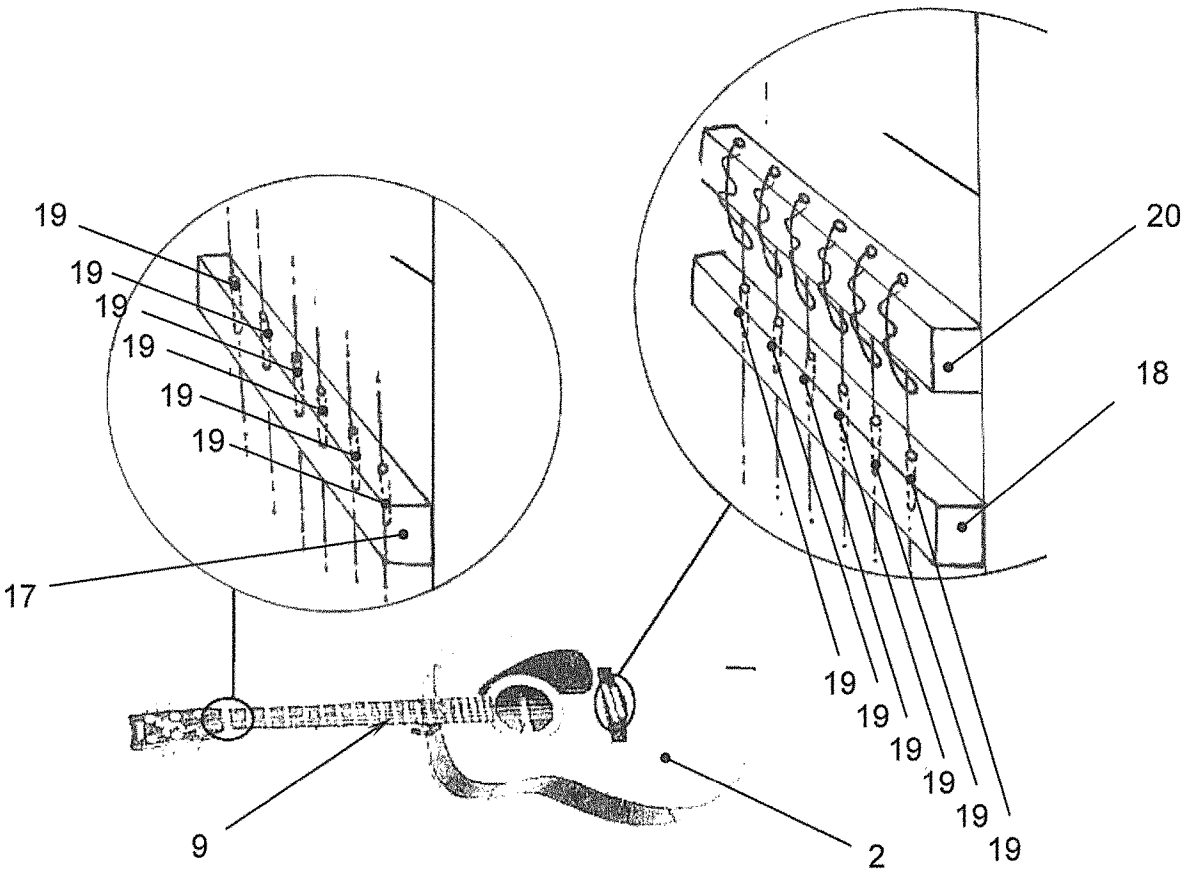

As shown in FIG. 6, the fret board 9 of the cord-type music instrument is laterally equipped with at least two longitudinal reinforcing elements 14, adapted to reinforce the fret board 9 of the cord-type music instrument and to guarantee its resistance to the pressing action of the thumb of the user's hand. The reinforcing elements 14 are arranged in parallel with the fret board 9 and fastened through a plurality of fastening means 5, such as, for example screws, nails, or other similar means.

Figure 8:
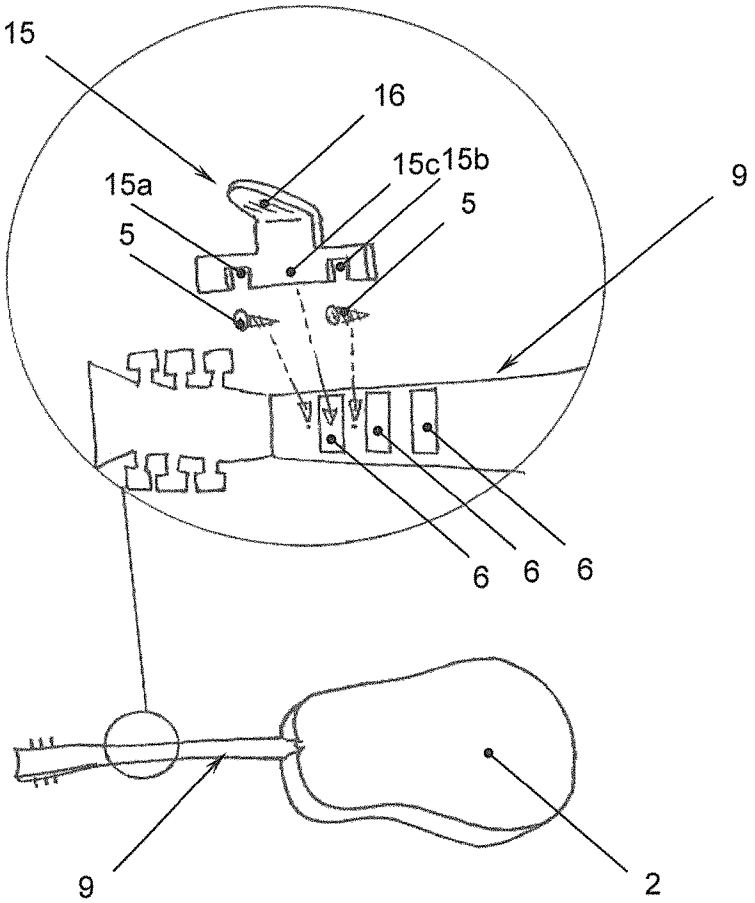

Moreover, the use and the performances of the cord-type music instrument equipped with a mechanical device 10 according to the present invention, are optimized by the manual insertion on the rear surface of the fret board 9, as shown in FIG. 8, of a mobile element 15, adapted to impress a constant pressing action on the bridge element 6, inducing a vertical upwards movement of the mechanical device 10, through the constant concentration of the elastic element 8. The pressing action induced by the mobile element 15 allows configuring the mechanical device 10, in a main fret 1.

The mobile element 15, as shown in FIG. 8, is composed of:

at least two slits 15*a*, 15*b* adapted to fasten the mobile element 15 on the rear surface of the fret board 9 through a plurality of fastening means 5;

a central body 15*c* adapted to be interfaced with the bridge element 6; and at least one knob element 16 adapted to allow an easy manual insertion of the mobile element 15 by a user.

Finally, the cord-type music instrument, equipped with the mechanical device 10, is optimized by the insertion on the main fret 1 of a first blocking means 17 of the plurality of chords, and by the placement on the harmonic box 2, in front of the chord-tending bridge 20, of a second blocking means 18.

The first and the second blocking means 17, 18 are parallelepiped element, equipped inside them with a plurality of channels 19, adapted to the passage and simultaneously to the blockage of the plurality of chords.

The invention has the following advantages: ensuring an ergonomic position of the hand and in particular of the user's thumb, since the integration of the mechanical device in the fret board of the cord-type music instrument does not change the arrangement of the cord-type music instrument itself;

reducing the incidence of the carpal tunnel syndrome, since the use of the mechanical device reduces the fatigue of the user's fingers of the music instrument;

allowing the integration of the mechanical device in the fret board of any cord-type music instrument, such as, for example, electric guitar, banjo, leg viol, cello, etc.;

ensuring the universally shared shaping and aesthetic of the traditional cord-type music instrument;

guaranteeing a direct check of the fret board and of the individual frets of the cord-type music instrument; and allowing disabled people to fully autonomously play a cord-type music instrument.

While certain representative embodiments and details have been shown for purposes of illustrating the invention, it will be apparent to those skilled in the art that various changes may be made without departing from the scope of the disclosure, which is further described in the following appended claims.

The invention claimed is:

1. A mechanical device integrated in a fret board of a cord-type music instrument as replacement of a fret, wherein the mechanical device crosses the fret board from the front surface to the rear surface of the fret board, the mechanical device comprising:

a bridge element arranged on the rear surface of the fret board;

rider means, adapted to vertically cross the fret board of the cord-type music instrument and to be connected to the bridge element, the rider means being composed of at least one horizontal element, placed on the front surface of the fret board of the cord-type music instrument and of at least two vertical elements connected on the top to the horizontal element, conferring to the rider means a π shape; and elastic means, equipped with a first end connected to the bridge element, and of a second end connected to a room obtained in the fret board.

2. The mechanical device of claim 1, adapted to perform a homogeneous pressure on a plurality of chords horizontally stretched on the fret board of the music instrument, the device being activated by at least one pressing action of the thumb of a user's hand, placed on the rear surface of the fret board, the pressing action being adapted to impress at least one force on the bridge element, the force being transmitted to the elastic element, the elastic element contracting itself inducing a vertical upwards movement of the mechanical device, enabling a contact in at least one point of the rider means with the plurality of chords of the music instrument, configuring the device in at least one dynamic phase.

3. The mechanical device of claim 1, wherein adapted to perform a homogeneous pressure on a plurality of chords horizontally stretched on the fret board of the music instrument, the device being activated by at least one pressing action of the thumb of a user's hand, placed on the rear surface of the fret board, the pressing action being adapted to impress at least one force on the bridge element, the pressing action of the thumb being followed by a release action of the bridge element, by the thumb, inducing a release of the elastic element, and a vertical downwards movement of the mechanical device configuring the device in at least one static phase.

4. The mechanical device of claim 1, wherein the fret board comprises, in its central portion, at least one removable keyboard portion fastened to the horizontal element, through at least one mechanical fastening system, adapted to enable a rotary movement by an angle of the removable keyboard portion.

5. The mechanical device of claim 4, wherein the fret board further comprises, in its central portion, the mechanical device, and at least one fixed keyboard portion.

6. The mechanical device of claim 4, wherein the removable keyboard portion comprises a first and a second lateral profile arranged in parallel with the horizontal element, and respectively fastened to the horizontal element, through the mechanical fastening system, to a first lateral profile of the fixed keyboard portion, through at least one chemical fastening system, enabling the rotary movement of the removable keyboard portion.

7. The mechanical device of claim 5, wherein the fixed keyboard portion comprises a first and a second lateral profile arranged in parallel to the horizontal element and to the removable keyboard portion, the second lateral profile of the portion of the keyboard portion being placed next to the horizontal element of the rider means.

8. The mechanical device of claim 4, wherein the mechanical fastening system comprises at least one connecting element, and the plurality of fastening means, and is adapted to connected the horizontal element to the first lateral profile of the removable keyboard portion, through a connection of each end of the horizontal element respectively with a third and a fourth profile of the removable keyboard portion.

9. The mechanical device of claim 2, wherein the pressing action induces, through the contraction of the elastic element, the vertical upwards movement of the horizontal element and a rotary movement by the angle of the removable keyboard portion connected to the horizontal element.

10. The mechanical device of claim 1, wherein the fret board is laterally equipped with at least two longitudinal reinforcing elements, adapted to reinforce the fret board, guaranteeing the resistance to the pressing action of the thumb of the hand of the user.

11. The mechanical device of claim 10, wherein the reinforcing elements are arranged in parallel with the fret board and fastened through the plurality of fastening means.

12. The mechanical device of claim 1, optimized by a manual insertion, on the rear surface of the fret board, of at least one mobile element, the mobile element being adapted to impress at least one constant pressing action on the bridge element, inducing the vertical upwards movement of the mechanical device, through a constant contraction of the elastic element, configuring the mechanical device, in the main fret.

13. The mechanical device of claim 12, wherein the mobile element is composed of:

at least two slits adapted to fasten the mobile element on the rear surface of the fret board through the plurality of fastening means;

at least one central body adapted to be interfaced with the bridge element; and at least one knob element adapted to allow an easy manual insertion of the mobile element by the user.

14. A cord-type music instrument, equipped with the mechanical device of claim 1, wherein optimized by an insertion on the main fret of at least one first blocking means of the plurality of chords, and by a positioning on the harmonic box of the music instrument, in front of at least one chord-tending bridge, of at least one second blocking means.

15. The cord-type music instrument of claim 14, wherein the first and second blocking means are parallelepiped elements, equipped inside them with a plurality of channels, adapted to the passage and simultaneously to the blockage of the plurality of chords.

* * * * *